US005846918A

United States Patent [19]

Meijer et al.

[11] Patent Number: 5,846,918

[45] Date of Patent: Dec. 8, 1998

[54] POLYMER THICKENED LUBRICANTS FOR HIGH OPERATING TEMPERATURES

[75] Inventors: Dick Meijer, Nieuwegein; Herman Lankamp, Bunnik, both of Netherlands

[73] Assignee: SKF Industrial Trading & Development Company B.V., Netherlands

[21] Appl. No.: 810,918

[22] Filed: Mar. 5, 1997

[30] Foreign Application Priority Data

Mar. 12, 1996 [NL] Netherlands ..... 1002586

[51] Int. Cl.[6] ..... C10M 119/02

[52] U.S. Cl. ..... 508/591; 585/12

[58] Field of Search ..... 585/10, 12; 508/591

[56] References Cited

U.S. PATENT DOCUMENTS

| | | | |
|---|---|---|---|
| 2,901,432 | 8/1959 | Morway et al. . | |
| 2,917,458 | 12/1959 | Morway et al. . | |
| 3,076,764 | 2/1963 | Hansen et al. | 585/10 |
| 3,114,708 | 12/1963 | Morway et al. | 585/10 |
| 3,216,935 | 11/1965 | Morway et al. . | |
| 3,290,244 | 12/1966 | Polishuk et al. . | |
| 3,392,119 | 7/1968 | Mitacek . | |
| 3,850,828 | 11/1974 | Dodson et al. | 585/10 |
| 4,435,299 | 3/1984 | Carley et al. . | |
| 5,139,425 | 8/1992 | Daviet et al. . | |

FOREIGN PATENT DOCUMENTS

| | | |
|---|---|---|
| 699334 | 12/1964 | Canada . |
| 905924 | 7/1972 | Canada . |
| 0 675 192 A1 | 10/1995 | European Pat. Off. . |
| A-0-700 986 | 3/1996 | European Pat. Off. . |
| 2162016 | 11/1972 | France . |
| A-6-322436 | 11/1994 | Japan . |
| 799465 | 8/1958 | United Kingdom . |

OTHER PUBLICATIONS

Chemical Abstracts, vol. 78, No. 14, Apr. 9, 1973, Columbus, Ohio, US; Abstract No. 86956m.

Chemical Abstracts, vol. 78, No. 14, Apr. 9, 1973, Columbus, Ohio, US; Abstract No. 86955k.

*Primary Examiner*—Jacqueline V. Howard
*Assistant Examiner*—Cephia D. Toomer
*Attorney, Agent, or Firm*—Oliff & Berridge, PLC

[57] ABSTRACT

A polymer thickened lubricating grease composition with improved resistance to high operating temperatures (constant and/or peak), containing 1) a lubricating base oil, 2) a polymeric thickener, containing a) a high melting point component comprising at least one polymer with a melting point (ASTM D-2117) of more than 200° C., especially more than 225° C., and b) a low molecular weight component comprising a (co- or homo-) polymer of propylene with a weight average molecular weight <100,000, and 3) optional further lubricating grease additives. The polymer thickener of the grease preferably further contains c) a high molecular weight component comprising a (co- or homo-) polymer of propylene with a weight average molecular weight >200,000. The grease preferably has a dropping point of >150° C., more preferably 180°–220° C., and is suitable for use in high operating temperature applications.

20 Claims, 4 Drawing Sheets

POLYMER THICKENED LUBRICANTS FOR HIGH OPERATING TEMPERATURES

BACKGROUND OF THE INVENTION

1. Field of the Invention

The present invention relates to polymer thickened lubricants for use at high operating temperatures. In particular the present invention relates to polymer thickened greases with a high dropping point.

2. Discussion of Related Art.

Polymer thickened lubricating greases and their preparation are known in the art.

U.S. Pat. No. 3,850,828 describes a lubricant grease composition, which is thickened with a polymeric mixture, comprising (1) a polyethylene with a molecular weight of 20,000–500,000, more preferably 50,000–250,000 and preferred polymer density above 0,94 gm/cc, and (2) an atactic polypropylene with a molecular weight preferable below 100,000 and a melt index above 20, preferably above 50. The ratio of the atactic polypropylene to the polyethylene is preferably 1:1 to 10:1, more preferably 2:1 to 5:1.

U.S. Pat. No. 2,917,458 describes a grease composition comprising an oil soluble amorphous polypropylene base having a molecular weight in the range of 300–10,000 and an intrinsic viscosity up to 0.4, 2 to 5 wt. % of an isotactic polypropylene having a molecular weight in the range of 100,000 to 1,000,000 and a melting point in the range of 250° to 410° F., and 5 to 35 wt. % of a soap type thickener.

According to this application "(. . .) high molecular weight isotactic polypropylenes can be satisfactorily incorporated in a grease containing mixed salts of high and low molecular weight organic acids, through the agency of an oil soluble amorphous polypropylene of select molecular weight (. . .). It has now been found that by the use of amorphous polypropylene of select molecular weight, the isotactic polypropylene is successfully made to blend with the oil."

Therefore, according to this reference, the low molecular weight amorphous polypropylene is dissolved in the oil and increases the compatibility of the oil with the isotactic polypropylene thickener. Also, according to this reference the grease always contains a conventional soap type thickener.

U.S. Pat. No. 3,290,244 describes a grease composition comprising a mineral lubricating oil, a thickening agent, and an oil soluble atactic homopolymer of polypropylene having a molecular weight in the range of 10,000–50,000 or an oil soluble atactic copolymer of ethylene and propylene having an intrinsic viscosity in the range of 0.3 to 4.0.

As a thickener, conventional thickeners such as fatty acid metallic soaps, inorganic thickeners such a colloids, silica and bentonite clay, etc. can be used in amounts of 5 to 40%.

According to this reference, the oil soluble atactic propylene polymer is dissolved in the oil present in the grease and serves to improve adhesion and cohesion. The use of a high molecular weight/low molecular weight polymeric thickener is neither described nor suggested.

Also, all the above references are silent with respect to the oil bleeding characteristics and/or the noise characteristics of the grease compositions obtained.

U.S. Pat. No. 3,392,119 describes a grease comprising a white mineral oil that has been thickened by the use of an ethylenecopolymer with a density at 25° C. of at least 0.4 g/cm$^3$ and a polypropylene homopolymer with a density at 25° C. of between 0.890 and 9.20 g/cm$^3$, the polyethylene to polypropylene weight ratio generally being in the range from about 10:1 to 1:10, preferably 3:1 to about 1:2.

According to this application "it was unexpectedly found that not only do white oils respond differently to such polyolefin thickening than do conventional lube oils, but the bleeding of the white oils with a polymer of ethylene and a polymer of polypropylene results in greases having improved non-bleeding characteristics", i.e. with reduced bleeding of the oil. According to the present application a grease with improved bleeding of the oil at low temperatures is obtained. Although it is possible to employ a white mineral oil according to U.S. Pat. No. 3,392,119 in the present invention it is less preferred, because it will generally lead to an inferior mechanical stability compared to the preferred embodiments described hereinbelow.

Also, this reference is again silent with respect to the noise characteristics of the grease composition.

European Patent Application 700986 (herein after referred to as EP 700986), which is incorporated by reference, describes polymeric thickeners for lubricating grease compositions, comprising a mixture of 1) a (co- or homo-) polymer of propylene with a weight average molecular weight >200,000 as a high molecular weight component, and
2) a (co- or homo-)polymer of propylene with a weight average molecular weight <100,000 as a low molecular weight component.

The low molecular weight component is preferably a polypropylene homopolymer with a melt flow rate (ASTM D-1238) of 500–1000, preferably 750–850.

The high molecular weight component is preferably a polypropylene homopolymer or a propylene/ethylene-copolymer with a melt flow rate (ASTM D-1238) of 1.5–15, preferably 1.5–7.

The weight ratio between the high molecular weight component and the low molecular weight component in the polymeric thickener is preferably 1:40–1:5, more preferably 1:25–1:15, even more preferably about 1:19.

EP 700986 also describes a lubricating grease composition comprising a lubricating base oil and said polymeric thickener, as well as a preferred method for preparing said grease composition, which comprises the following steps:

a) preparing the above mentioned thickener composition;
b) mixing this thickener with a lubricating base oil at a temperature above the melting point of said polymer, preferably 190–210° C., and
c) cooling the grease composition thus obtained from the mixing temperature to room temperature in 1 sec.–3 min., preferably 10 sec.–1 min., more preferably around 30 sec.

This preferred method of preparation, which comprises rapid cooling of the grease composition, is referred to as "quenching".

It is stated that the grease compositions according to EP 700986 have improved oil bleeding characteristics at low temperature, improved noise characteristics and improved mechanical stability, especially when they are prepared with "quenching".

Despite these very desirable characteristics, the polymer thickened lubricating greases of the EP 700986 have one great disadvantage, which is that they cannot be used at high operating temperatures of the bearing. This is because at these higher temperatures, the grease quickly loses its stiffness and flows from the bearing, which leads to reduced lubrication and a drastically reduced bearing life.

It has now been found that this loss of stiffness is probably due to the fact that, at higher running temperatures, the polymeric thickener used according to EP 700986 loses its "sponge-like" thickener structure and can no longer hold the oil in place.

This instability at higher temperatures is usually not a problem for the preferred low temperature applications of the greases of EP 700986, for which they are especially suited due to their excellent oil bleeding characteristics at low temperatures. Also, these polymer thickened greases will usually be remain stable at normal running temperatures of bearings in many industrial, household, etc., as well as automotive applications, which lie in the range of 50–120° C.

However, these greases will fail at running peak temperatures above 140° C.

Therefore, the polymer thickened lubricating greases of the abovementioned prior art are not suited for high running temperature applications. Furthermore, compared to the polymer thickened lubricating greases of EP 95202464.4, they suffer from inferior mechanical stability, inferior noise characteristics, and inferior oil bleeding characteristics at low temperature. In this respect, it should be noted that, even for high temperature applications, poor oil bleeding characteristics at low temperature can be a problem when "starting up" the bearing, for instance when starting a motorcar in winter.

Some polymer-thickened greases for use at high temperatures are known in the art. However, these greases still do not possess satisfactory lubricating properties, such as those mentioned above.

For instance, U.S. Pat. No. 3,076,764 describes a grease composition which is thickened with an isotactic polymer of 4-methyl-1-pentene, which is mentioned to be "useful at high temperature services" and to have a dropping point higher than 419° F. (215° C.).

However, although polymers of 4-methyl-1-pentene, such as the commercially available TPX by Mitsui, can be used as the high melting point component in accordance with the present invention, greases thickened with poly(4-methyl-1-pentene) alone have been found to show inferior lubricating properties, in particular poor mechanical stability and too much oil bleeding (vide the Example hereinbelow).

U.S. Pat. No. 3,216,935 describes a grease composition comprising a "high molecular weight crystalline polypropylene as a grease thickener, and petroleum resin to stabilize the polypropylene against separation from the oil". According to one Example of this reference, the grease has a dropping point of 375° F.; however, this high dropping point is not due to the polymeric thickener, but to the presence of dispersed calcium acetate in the grease.

SUMMARY OF THE INVENTION

One object of the invention is therefore to provide a polymer thickened lubricating grease, which has all the advantages vis-a-vis mechanical stability, oil bleeding characteristics at low temperature and noise characteristics of the greases of EP 700986, and also a wide temperature range, especially with respect to improved resistance to high operating temperatures (constant and/or peak). Such greases would be able to function well both at low temperatures as well as high temperatures.

It has now been found that such a polymer thickened lubricating grease can be provided by using as a thickener at least one polymer which has a melting point (ASTM D-2117) of more than 200° C., especially more than 225° C., in combination with a polypropylene component, in particular with at least the "low molecular weight" component of the polymeric thickener of EP 700986, and preferably with both the "low molecular weight" and the "high molecular weight" component of EP 700986, the grease thus obtained has mechanical stability, oil bleeding characteristics at low temperature, and low noise characteristics.

DETAILED DESCRIPTION OF PREFERRED EMBODIMENTS

Figure 1A:
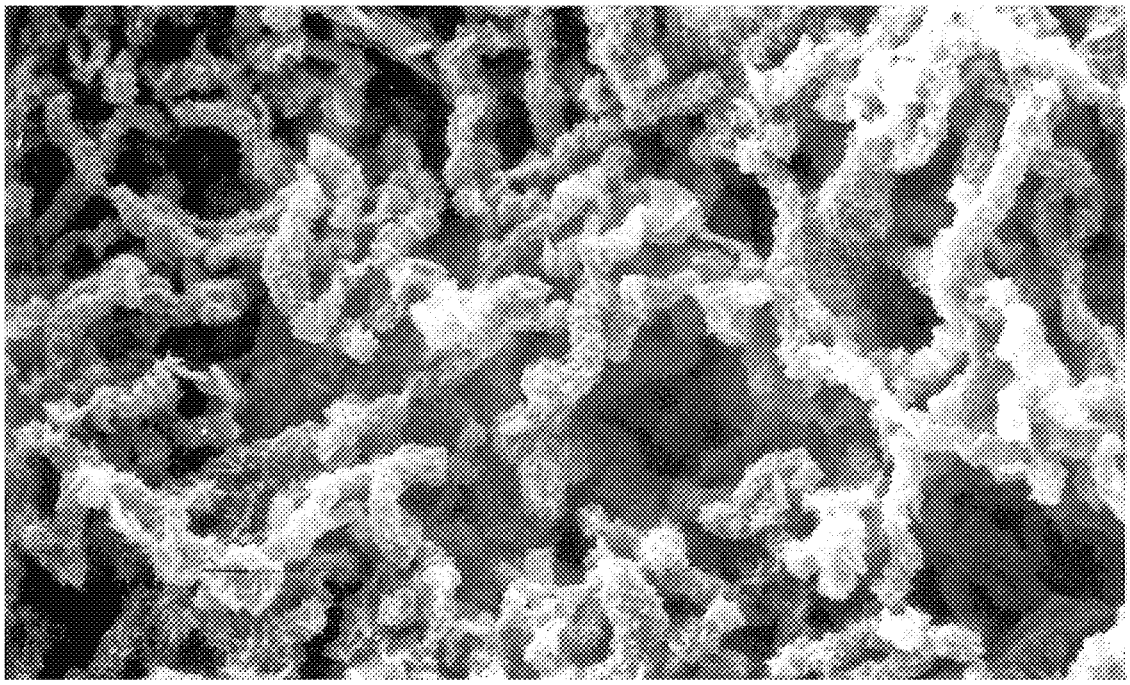
FIGS. 1(A), 1(B) and 1(C) are scanning electron micrographs of a grease of the Example, prepared with slow cooling, at magnifications of 1,000, 5,000 and 10,000 respectively.
Figure 1B:
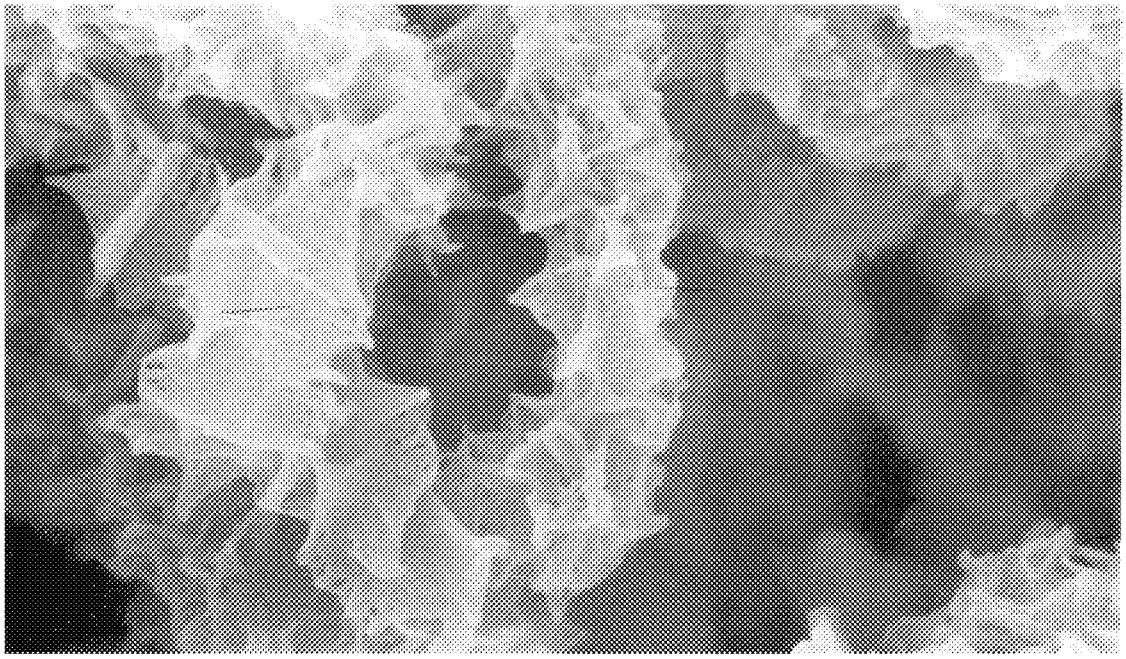
Figure 1C:
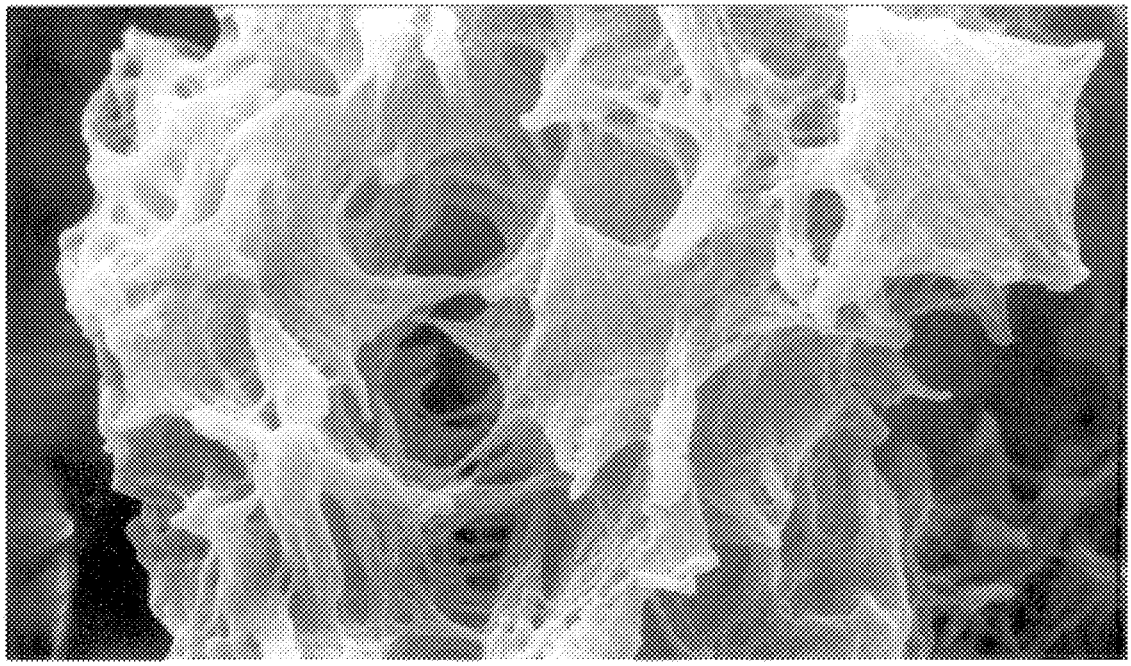
Figure 2A:
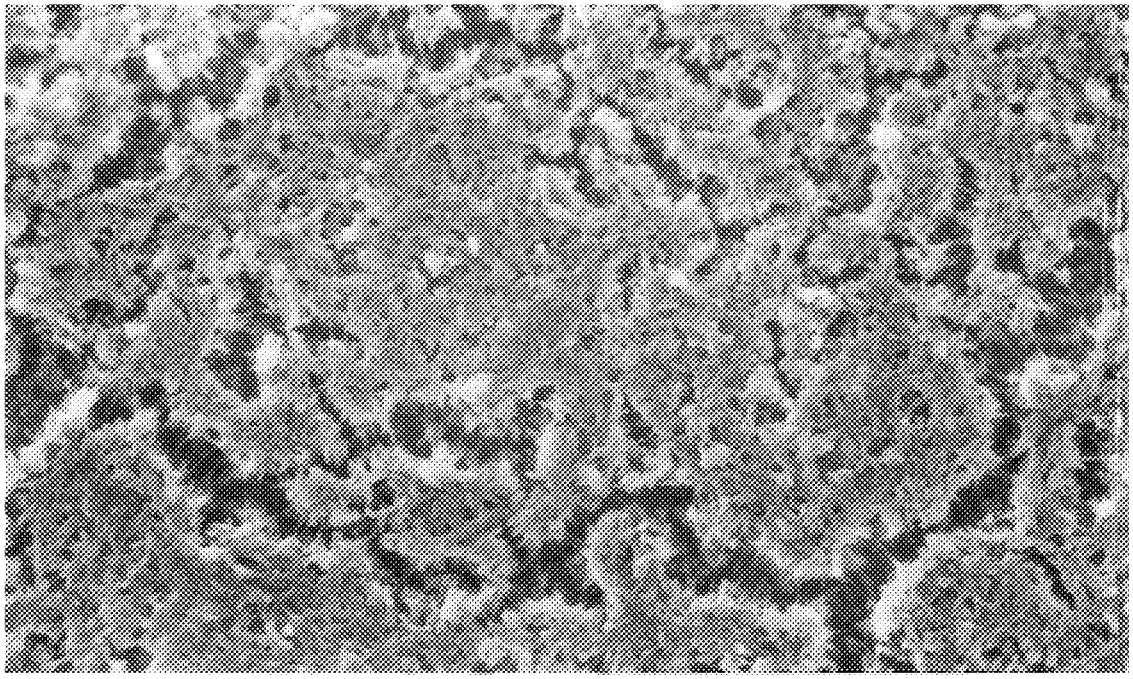
FIGS. 2(A), 2(B) and 2(C) are scanning electron micrographs of the same grease of the Example, prepared by quenching, at the same magnifications of 1,000, 5,000 and 10,000 respectively.
Figure 2B:
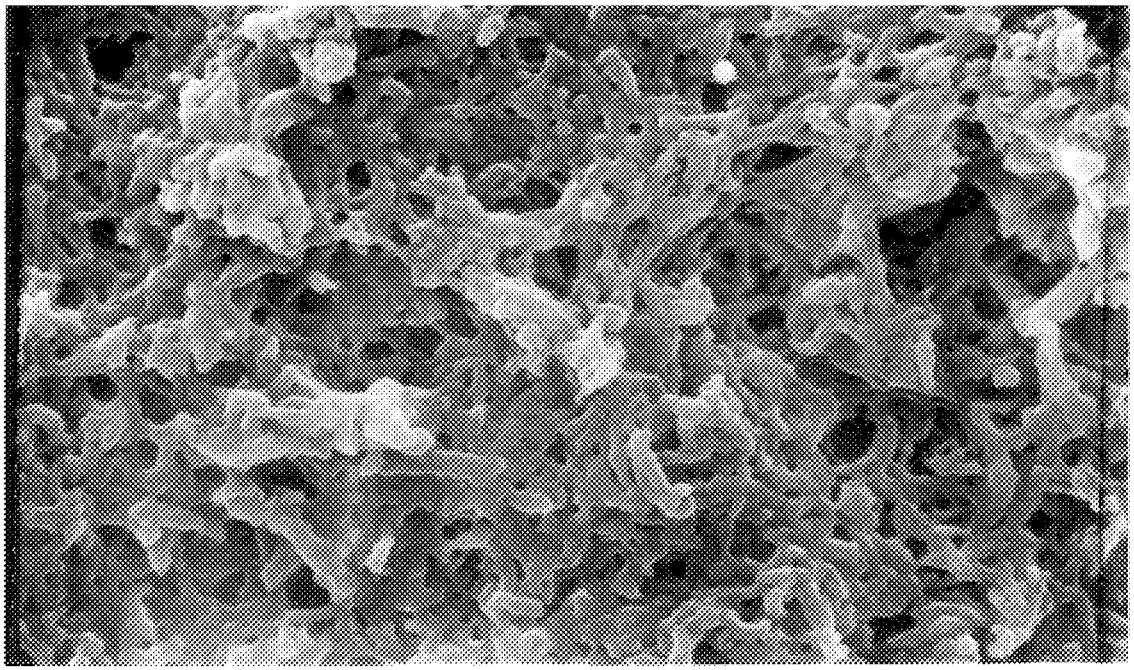
Figure 2C:
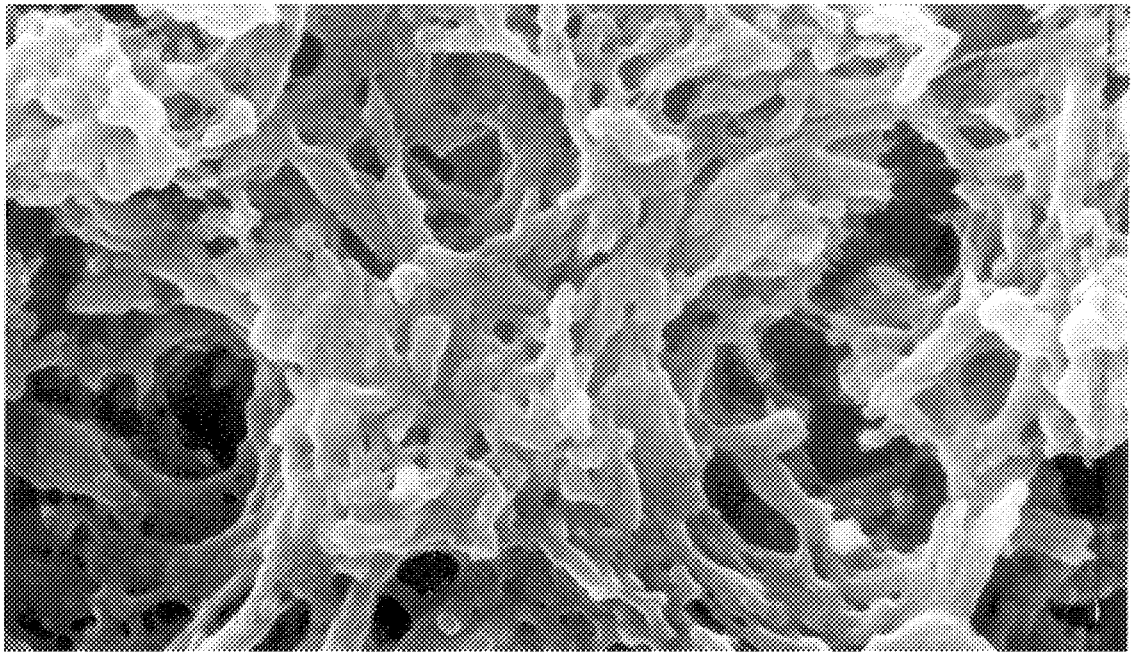

The present invention therefore relates to a polymer thickened lubricating grease composition, which comprises 1) a lubricating base oil
2) a polymeric thickener, comprising
   - 2a) at least one polymer with a melting point (ASTM D-2117) of more than 200° C., especially more than 225° C. (hereinbelow referred to as the "high melting point component"); and preferably also
   - 2b) a "low molecular weight component" according to EP 700986; and more preferably also
   - 2c) a "high molecular weight component" according to EP 700986; and
3) optionally further additives known per se.

The present invention further relates to a polymeric thickener for lubricating grease compositions, which comprises

- 2a) at least one polymer with a melting point (ASTM D-2117) of more than 200° C., especially more than 225° C. (the "high melting point component");
- 2b) a "low molecular weight component" according to EP 700986 and preferably also
- 2c) a "high molecular weight component" according to EP 7009864.

and optionally further additives known per se.

Preferably, the "high melting point" component comprises one or more polyalkylene polymers, especially a methylpentene polymer, such as the polymer marketed by Mitsui Petrochemical Industries under the brandname TPX, especially type DX820. This polymer has a melting point (ASTM D-2117) of 235° C., a density (ASTM D-1505) of 0,83 g/m$^3$, a melt flow rate (ASTM D-1238) of 160–200 (g/10 min.) and a hardness (ASTM D-785) (R-scale) of 90.

The "low molecular weight component" is as described in EP 700986, which is incorporated herein by reference. Preferably, it is at least one (co- or homo-)polymer of polypropylene with a weight average molecular weight $\leqq$100,000, preferably 50,000–100,000, more preferably a polypropylene homopolymer with a melt flow rate of 500–1000 dg/min., especially 750–850 dg/min., as determined by test ASTM D-1238 L.

The "high molecular weight component" is also as described in EP 700986, which is incorporated herein by reference. Preferably, it is at least one co- or homo-polymer of propylene with a weight average molecular weight >200,000, preferably 200,000–500,000, more preferably a polypropylene homo- or a propylene/ethylene-copolymer with a melt flow rate (ASTM D-1238) of 1.5–15, preferably 1.5–7.

According to the invention, it has been found that greases which only comprise the "high melting point component" as a thickener, although they fall within the general scope of the invention, will usually have poor mechanical stability and too much oil bleeding, even though the quiet running behaviour may be acceptable. The mechanical stability can be improved by incorporating at least the low molecular weight component, and even more by using a combination of the low molecular weight component and the high molecular weight component.

Therefore, although the invention encompasses the use of the high melting point polymer as the only polymeric thickener in the grease, the preferred composition of the polymeric thickener of the invention is:

high melting point component: 99–10 wt. %, preferably 95–40 wt. %, more preferably 75–55 wt. %, low molecular weight component 75–1 wt. %, preferably 60–10 wt. % more preferably 40–25 wt. %, high molecular weight component 0–25%, preferably 0–15 wt. %, more preferably 1–10 wt. % the weight % making up a sum total of 100 wt. % and being based upon the total weight of the polymeric thickener.

When both a low molecular weight component and a high molecular weight component are used in the polymeric thickener, their weight ratio is preferably 25:1–5:1, more preferably around 10:1.

In any case however, the amounts of the high melting point component, the low molecular weight component and high molecular weight component should be chosen such that the desired high temperature characteristics are obtained, as can be determined by a man skilled in the art.

The polymeric thickener according to the invention is generally used in the lubricating grease composition in conventional amounts, i.e. 5–30 wt. %, preferably 10–20 wt. %, especially around 15 wt. % of the total grease composition. Other amounts can be used if desired.

As the lubricating base oil any lubricating oil known per se may be used, such as mineral oils, synthetic hydrocarbons, ester oils and mixtures thereof, of different viscosity. The type of base oil and viscosity can be selected to suit specific applications.

However, as the lubricating greases of the present application are intended for high operating temperatures and need to withstand the high temperatures during the dissolving step of the grease production process, preferably lubricating base oils are used that are also resistant to these high running and preparation temperatures. As examples thereof pure paraffinic lubricating oils, hindered esters (i.e. hindered for oxidation) and poly-α-olefins (such as the SHC oils marketed by Mobil) can be mentioned. These oils are especially stable against oxidation above 200° C.

Furthermore, additives known per se may be incorporated in the lubricant grease composition, as long as they do not have a detrimental effect on the thickener composition, the base oil and/or the final grease composition. As such, anti-wear and anti-corrosion additives as well as anti-oxidants etc. may be incorporated in conventional amounts in a manner known per se.

Also, although not preferred, the polymeric thickener and/or the lubricant grease composition according to the invention may also contain conventional thickeners for lubricant grease compositions, such as metal soaps, in amounts of less than 50 wt. %, preferably less than 10 wt. %. Most preferably, however, the lubricant grease compositions according to the invention contain only polymeric thickeners, most preferably the polymeric thickener mixture as described hereinabove.

As a measure for the high temperature performance of the lubricating greases of the present invention, the dropping point according to DIN ISO 2176 can be used. Preferably, the greases of the present invention have a dropping point >150° C., preferably in the range 170°–250° C., more preferably 180°–220° C., although the upper limit is usually not essential. For comparison, the greases of EP 700986 will have a dropping point of approximately 140° C.

The polymeric thickeners of the present invention can be incorporated into a lubricating grease in any manner known per se, such as the general method described in EP 700986, which is incorporated herein by reference. This method generally comprises melting the polymeric thickener and mixing/dissolving the melted thickener with/in one or more lubricating base oils and the optional further additives, after which the grease composition thus obtained is cooled to around room temperature. The preparation is preferably carried out under a protective atmosphere, such as a nitrogen gasflow, to avoid oxidation of the oils during heating.

Preferably, however, the greases of the invention are prepared via the perferred method of "quenching" described in the EP 700986, incorporated herein by reference. This means that the polymeric thickener is dissolved in the desired base oil at temperatures above the melting point of the polymer with the highest melting point. After that, the grease composition is rapidly cooled to room temperature ("quenched"), preferably in a period of time between 1 sec. and 3 min., preferably 10 sec.–1 min., more preferably about 30 sec.

As described in the EP 700986, this quenching can for instance be carried out by pooring the grease composition on a watercooled metal plate, although any other suitable rapid cooling method may also be used, such as spraying.

Also as described in the EP 700986, the quenching process according to the invention has a major influence on the grease structure, giving significant improvement of the properties of the final grease compositions compared to both conventional soap thickened lubricating greases, as well as lubricating greases according to the invention which are cooled slowly, e.g. in approximately 1 degree per minute by the use of conventional cooling methods, such as simply keeping the grease in the reaction vessel with external/internal cooling. This results, for the polymer grease, in a lubricant lacking any mechanical stability.

In the polymer-thickened lubricating grease according to the invention, the polymeric thickener forms a sponge-like structure, which gives the grease its appearance and structure. The lubricating base oil is kept within the pore-like spaces within the thickener structure, and bleeds out during service of the grease. In greases which are slowly cooled during their preparation, the thickener-structure is very irregular with large pores as well as very small pores. The above indicated quenching of the lubricant grease composition provides a grease according to the invention with a smoother and more uniform structure of the polymeric thickener, with more uniformly distributed spaces for keeping the lubricant oil.

Although in its broadest sense the invention is not restricted to any method for preparing the grease nor to any explanation as to how the improved properties of the grease composition according to the invention are obtained, it is believed that the smoother and more uniform thickener structure obtained by quenching has a beneficial influence on the final properties of the grease composition, such as the mechanical properties, the oil bleeding characteristics, the noise characteristics, as well as the transport of the oil within the grease structure, so that the properties of the polymer-thickened grease compositions obtained by the use of the polymeric thickener according to the invention are improved even further.

As to improved high temperature characteristics, it is assumed that the polymeric thickener comprising the high melting point component loses its structure at a higher temperature than the known polymeric greases. When a mixture of components is used, it is possible that part of the polymeric thickener is lost from the thickener structure at the operating temperature of the bearing, after which the other components of the grease (especially the high melting point component) will still provide the thickener structure and thus the stiffness of the grease. Also, it is possible that the thickener loses its structure over a temperature range, which will be higher than the temperature at which the separate components would loose their structure. In any case, the invention is not particularly limited to any explanation or any mechamism via which the high temperature characteristics are obtained.

Because during the preparation of the grease, the polymer (s) making up the thickener must be dissolved at a temperature above its/their melting point, the upper limit of the melting point of said polymer/-thickener -although not essential for the invention and not particularly limited- should not be so high as to make the preparation of the grease technically difficult or impossible, or too high for the base oil used. Also, the melting point of the polymer should not be such that said polymer detracts from the properties of the final grease. A practical upper limit for the melting point of the polymer/thickener is 350° C., but usually the melting point will not be higher than 275° C.

After the grease lubricant composition has been cooled, preferably quenched, from its preparation temperature to ambient temperature, the grease is "worked" to the required final consistency for its intended use. This can be carried out in a conventional manner, for instance in a three-roll mill or a grease worker. During the working of the grease, further additives can be added as is well known to a man skilled in the art. After "working", the grease is ready for use.

The consistency of the grease can be classified by means of the NLGI-class. According to the present invention the grease can usually be prepared to a NLGI-class range 1 to 3. An NLGI-class of 0 can be made, however, will usually give undue grease leakage.

The mechanical stability of the grease can be ascertained by means of tests known in the art, such as the Shell roll stability test. Preferably, the grease will have a penetration change after the Shell roll stability test (24 hrs at 60° C., 165 rpm), of max. 80 points.

It must be understood, however, that the present invention allows the man skilled in the art to obtain a grease with the consistency and mechanical stability as desired and/or required for the intended application of the grease by selecting the components as well as the conditions for preparing the grease, which aspects fall within the scope of a man skilled in the art of lubricants.

Also, the viscosity of the separated oil must be acceptable, and preferably be constant.

Besides the broader temperature range and better high temperature characteristics, the use of the polymeric thickener of the present invention provides the same advantages as the EP 95202464.4, which is incorporated herein by reference, in particular:

- improved bleeding of the oil at low temperatures (room temperature [20° C.] or less);
- oil bleeding characteristics ( for example according to DIN 51817) that are less temperature-dependent than the characteristics of lubricant grease compositions known in the state of the art;
- better transport of the oil within the grease structure, which leads to improved grease service life;
- good lubricating ability at low temperatures (below 70° C.);
- good mechanical stability, i.e. "roll" stability/shear stability;
- improved grease noise characteristics, i.e. a low noise level of the lubricated bearing in the SKF BEQUIET-test described in the SKF publication E4147.
- long relubrication intervals.

The polymer-thickened grease composition according to the present invention can be used for all conventional applications for lubricant grease compositions, so long as these are compatible with the components of the lubricant grease composition. The greases are however especially suited for applications in which a high operating and/or running temperature of the bearing (constant and/or peak) is expected, or where the greases can come into contact with high temperature surfaces and/or parts. Examples thereof are automotive applications and apparatus that convert mechanical energy to electrical energy or visa versa, such as alternators.

Also, on account of the long(er) relubrication intervals compared to conventional greases, the compositions according to the invention can advantageously be used with advantage in such applications when frequent relubrication is unpractical or undesired.

The invention therefore further relates to the use of a polymeric thickener as described hereinabove for the preparation of lubricating grease compositions with one or more of the following properties: improved high temperature stability, improved oil bleeding characteristics, especially at low temperatures, mechanical stability under shear, and/or for the preparation of lubricant grease composition with improved quiet running characteristics, respectively.

Finally, the invention relates to a method for lubricating a rolling element bearing, which is used at high operating/running temperatures (constant and/or peak), in which a grease according to the invention is used.

The invention will now be illustrated by means of the following non-limiting Example.

EXAMPLE

Current polymer thickened greases use of polymers have a melting point below 200° C. This results in greases having a dropping point of approximately of 140° C. For extended use of such greases a thickener system leading to higher dropping point is desirable. Therefore, the possibilities for using polymers with higher melting points were explored.

A methylpentene polymer was selected because it is a polyalkylene polymer with the highest melting point (i.e. 235° C.). The polymer was supplied by Mitsui Petrochemical Industries Ltd under the brand name is TPX. The type DX 820 was used for evaluation as candidate thickener component. A summary of physical properties of TPX DX 820 is given in Table 1.

TABLE 1

Physical properties of TPX DX820

| Property | Method | Unit | Suppliers data |
|---|---|---|---|
| Melting point | ASTM D2117 | °C. | 235 |
| Density | ASTM D1505 | $g/m^3$ | 0.83 |
| Meltflow rate | ASTM D1238 | g/10 min | 160–200 |
| Hardness | ASTM D 785 | (R scale) | 90 |

The TPX containing lubricants were prepared with "quenching" essentially as described in the non-prepublished European application 700986, incorporated herein by reference. However, the temperature for dissolving of TPX was set on 245° C.

Grease made with pure TPX DX820 as thickener component resulted in a lubricant with a dropping point more than 180° C. and in noise level a BQ2 rating in the SKF-BEQUIET test could be reached. However, poor mechanical stability and too much oil bleeding was observed.

To improve the mechanical stability, a number of lubricants, applying a mixture of TPX DX820 with the propylene polymers Valtec HH442H and/or SB3511J, were made.

Typical test results are given in Table 2.

TABLE 2

| Grease composition | Dropping point | Quiet running behaviour | Consistency after working |
|---|---|---|---|
| TPX/Valtec, 3:1: 12% | >180 | 98% BQ2 | >390 |
| TPX/Valtec/SB3511J 62.75/33.5/3.75: 14% | 170–180 | 97% BQ2 | 360 |
| TPX/Valtec/SB3511J 62.75/33.5/3.75: 17% | 200–210 | 75% BQ2 | 250 |

These mixtures showed improved mechanical stability. The thickener composition of best grease in this respect was formulated as follows: total thickener content 17% and consisting of 62.75% TPX DX820; 33.5% Valtec HH442H; 3.75% SB3511J. This grease is unworked very hard and crumbly and it cannot be worked in the standard grease-worker. Therefore, the grease was worked on the 3-roll mill until an acceptable consistency.

This provided a polymer thickened greases with wider operating temperature range (dropping point well above 180° C.).

What we claim is:

1. Polymer thickened lubricating grease composition, comprising a lubricating base oil, and a polymeric thickener, comprising a high melting point component comprising at least one polymer with a melting point (ASTM D-2117) of more than 200° C. and a low molecular weight component comprising one or more of a copolymer or homopolymer of propylene with a weight average molecular weight of from 50,000 to 100,000.

2. Polymer thickened lubricating grease composition according to claim 1, wherein the polymeric thickener further comprises a high molecular weight component comprising one or more of a copolymer or homopolymer of propylene with a weight average molecular weight of 200,000 or more.

3. Polymeric thickener for lubricant grease compositions, comprising a high melting point component comprising at least one polymer with a melting point (ASTM D-2117) of more than 200° C. and a low molecular weight component comprising one or more of a copolymer or homopolymer of propylene with a weight average molecular weight of from 50,000 to 100,000.

4. Polymeric thickener according to claim 3, wherein the thickener further comprises a high molecular weight component comprising one or more of a copolymer or homopolymer of propylene with a weight average molecular weight of 200,000 or more.

5. Lubricating grease composition according to claim 1, wherein the high melting point component comprises a polyalkylene polymer.

6. Lubricating grease composition according to claim 1, wherein the low molecular weight component comprises a polypropylene homopolymer with an average molecular weight of 50,000 to 100,000 and a melt flow rate of 500–1000 dg/min., as determined by test ASTM D-1238 L.

7. Lubricating grease composition according to claim 2, wherein the high molecular weight component comprises a propylene homopolymer or a propylene/ethylene-copolymer with an average molecular weight of 200,000 to 250,000 and a melt flow rate (ASTM D-1238) of 1.5–15.

8. Lubricating grease composition according to claim 2, wherein the polymeric thickener comprises:

99–10 wt. % of the high melting point component,

75–1 wt. % of the low molecular weight component, and

1–10 wt. % of the high molecular weight component, the wt. % making up a sum total of 100 wt. % and being based upon the total weight of the polymeric thickener.

9. Lubricating grease composition according to claim 1, wherein the polymeric thickener is present in an amount of 5–30 wt. % of the total grease composition.

10. Method for preparing a polymer thickened grease composition comprising the following steps:

a) preparing a thickener composition according to claim 3, b) mixing or dissolving the thickener composition with or in a lubricating base oil at a temperature above the melting point of the thickener composition to obtain a grease composition, and c) cooling the grease composition.

11. Method according to claim 10, wherein the grease composition is cooled from the mixing or dissolving temperature to room temperature in 1 sec.–3 min.

12. Lubricating grease composition, produced by the method of claim 10.

13. Polymer thickened lubricating grease composition according to claim 1, wherein the grease composition has a dropping point of greater than 150° C.

14. A method of lubricating, comprising contacting a material to be lubricated with a grease composition according to claim 1, and subjecting the material to high operating temperatures above 140° C.

15. Polymer thickened grease composition according to claim 1, wherein the composition further comprises conventional additives.

16. Lubricating grease composition according to claim 5, wherein the high melting point component comprises a methylpentene polymer.

17. Lubricating grease composition according to claim 8, wherein the polymeric thickener comprises:

75–55 wt. % of the high melting point component,

40–25 wt. % of the low molecular weight component, and

1–10 wt. % of the high molecular weight component, the wt. % making up a sum total of 100 wt. % and being based upon the total weight of the polymeric thickener.

18. Lubricating grease composition according to claim 9, wherein the polymeric thickener is present in an amount of 10–20 wt. % of the total grease composition.

19. Method according to claim 11, wherein the grease composition is cooled from the mixing or dissolving temperature to room temperature in 10 sec.–1 min.

20. Polymer thickened lubricating grease composition according to claim 13, wherein the grease composition has a dropping point of 180°–220° C.

* * * * *